US010400338B2

(12) United States Patent
Cruson et al.

(10) Patent No.: US 10,400,338 B2
(45) Date of Patent: Sep. 3, 2019

(54) PH STABLE TRIVALENT CHROMIUM COATING SOLUTIONS

(71) Applicant: Chemeon Surface Technology, LLC, Minden, NV (US)

(72) Inventors: Jake Cruson, Dayton, NV (US); Sjon Westre, Carson City, NV (US)

(73) Assignee: Chemeon Surface Technology, LLC, Minden, NV (US)

( * ) Notice: Subject to any disclaimer, the term of this patent is extended or adjusted under 35 U.S.C. 154(b) by 0 days.

(21) Appl. No.: 15/978,980

(22) Filed: May 14, 2018

(65) Prior Publication Data

US 2018/0327909 A1 Nov. 15, 2018

Related U.S. Application Data

(60) Provisional application No. 62/505,723, filed on May 12, 2017.

(51) Int. Cl.
*C23C 22/34* (2006.01)
*C23C 22/00* (2006.01)

(52) U.S. Cl.
CPC ..... *C23C 22/34* (2013.01); *C23C 2222/10* (2013.01)

(58) Field of Classification Search
CPC .. C23C 2220/10; C23C 2222/10; C23C 22/34
See application file for complete search history.

(56) References Cited

U.S. PATENT DOCUMENTS 4,359,348 A 11/1982 Crotty
4,705,576 A 11/1987 Klos et al.
5,091,023 A 2/1992 Saeki et al.
5,304,257 A 4/1994 Pearlstein et al.
6,648,986 B1 11/2003 Tang et al.
6,669,764 B1 12/2003 Matzdorf et al.
(Continued)

FOREIGN PATENT DOCUMENTS

CA 1261716 A1 9/1989
CA 2303101 A1 3/1999
(Continued)

OTHER PUBLICATIONS

Alodine, T 5900 RTU Conversion Coating Process for Aluminum, Technical Process Bulletin, Process No. 239582, Henkel Surface Technology, Apr. 12, 2005 (4 pp.).
(Continued)

*Primary Examiner* — Lois L Zheng
(74) *Attorney, Agent, or Firm* — Holland & Hart, LLP

(57) ABSTRACT

A stable trivalent chromium coating solution can be prepared by heating the chromium coating solution and adjusting the pH of the chromium coating solution. The coating solution can be heated to at least 35° C. for no more than 24 hours. While the solution is hot, a basic or acidic material can be added to increase or reduce the pH to a target value, respectively. In some embodiments, the chromium coating solution can have a pH of 3.5 to 4.0 and the pH can vary no more than ±0.15 while in storage for at least 20 days. The trivalent chromium coating solution can include a fluoride compound, a zirconate compound, a corrosion inhibitor compound, a chelating agent, a phosphorous compound, and/or other compounds.

31 Claims, 3 Drawing Sheets

(56) References Cited

U.S. PATENT DOCUMENTS

| | | | | |
|---|---|---|---|---|
| 7,108,923 | B1 | 9/2006 | Ito et al. | |
| 7,691,498 | B2 | 4/2010 | Kendig | |
| 7,811,391 | B2 | 10/2010 | Matzdorf et al. | |
| 7,887,938 | B2 | 2/2011 | Fristad et al. | |
| 7,989,078 | B2 | 8/2011 | Jaworowski et al. | |
| 8,092,617 | B2 | 1/2012 | Kramer et al. | |
| 9,315,902 | B2 | 4/2016 | Sugiura et al. | |
| 9,487,866 | B2 | 11/2016 | Kramer et al. | |
| 2002/0033368 | A1 | 3/2002 | Nasu et al. | |
| 2004/0000358 | A1* | 1/2004 | Bhatia | C23C 22/34 148/250 |
| 2007/0089808 | A1 | 4/2007 | Hashimoto | |
| 2007/0243397 | A1 | 10/2007 | Lugwig et al. | |
| 2010/0300891 | A1* | 12/2010 | Rivera | C09D 5/084 205/319 |
| 2012/0024714 | A1 | 2/2012 | Kwon et al. | |
| 2018/0216234 | A1* | 8/2018 | Westre | C23C 22/08 |

FOREIGN PATENT DOCUMENTS

| | | | |
|---|---|---|---|
| CA | 2433122 | C | 2/2007 |
| CN | 100567569 | C | 12/2009 |
| EP | 0337411 | B1 | 12/1993 |
| JP | H06173027 | A | 6/1994 |
| KR | 20110033656 | A | 3/2011 |
| WO | WO-2006132426 | A2 | 12/2006 |

OTHER PUBLICATIONS

Bonderite M-CR T5900 RTU Aero Chromate Coating, Technical Process Bulletin, PDF file created on Aug. 6, 2013 (see "Date Information" section below for more information) (4 pp.).

Bonderite M-CR T5900 RTU Aero known as Alodine T 5900 RTU, Safety Data Sheet, IDH No. 772744, Henkel, Jun. 23, 2017 (6 pp.).

Chapaneri, R., A Study of Hexavalent and Trivalent Chromium Conversion Coatings on Zinc Surfaces, Loughborough University, 2010 (258 pp.).

Chemeon TCP-NP, Technical Data Sheet, Chemeon Surface Technology, 2016 (9 pp.).

Chemeon TCP-HF, Technical Data Sheet, Chemeon Surface Technology, 2015 (8 pp.).

SurTec 650 RTU chromitAL TCP—RUT Ready to Use Solution, SurTec, Feb. 20, 2017 (3 pp.).

International Search Report and Written Opinion from corresponding PCT App. No. PCT/US2018/032564, Aug. 8, 2018 (8 pp.).

ATMP, Wikipedia, https://en.wikipedia.org/wiki/ATMP, Jul. 7, 2015 (2 pp.).

* cited by examiner

PH STABLE TRIVALENT CHROMIUM COATING SOLUTIONS

BACKGROUND OF SOME ASPECTS OF THIS SPECIFICATION

Chromium conversion coatings are coatings for metals where the part surface is converted into the coating with a chemical or electro-chemical process. Conversion coatings containing hexavalent chromium have been used for many years to passivate steel, aluminum, zinc, cadmium, copper, silver, magnesium, and tin alloys. It is primarily used as a corrosion inhibitor, primer, decorative finish, or to retain electrical conductivity.

Hexavalent chromium conversion coatings have fallen out of favor due to the toxicity of hexavalent chromium. In many locations, hexavalent chromium is highly regulated and subject to various use and handling restrictions. Hexavalent chromium conversion coatings are slowly being replaced by non-hexavalent chromium conversion coatings, particularly those utilizing trivalent chromium. Trivalent chromium conversion coatings are an environmentally friendly and superior alternative to hexavalent chromate coatings. They can be used in extreme applications to provide superior wear and corrosion resistance while also being more economical in cost per application.

The performance of various trivalent chromium coatings is sensitive to the pH of the coating solution at the time of application. If the pH of the coating solution is too high or too low, the coating does not provide the desired level of performance—e.g., with respect to corrosion resistance, paint adhesion, electronic resistance, etc. This is a problem because conventional trivalent chromium coating solutions are not pH stable; the pH of the solution has a tendency to drift over time. This also means that before each use, the pH of the solution should be checked and adjusted if it is too high or too low. Measuring and adjusting the pH before each use is a tedious process.

SUMMARY OF SOME ASPECTS OF THIS SPECIFICATION

The inventors believes they have discovered the problems with the prior art, or at least their severity, noted above. They have therefore invented a process for stabilizing the pH of a trivalent chromium coating solution includes adjusting the pH of the coating solution while it is being heated. The process can also include cooling the solution and/or filtering any solids out of the solution.

The process can be used to produce pH stabilized trivalent chromium coating solutions. The coating solutions can include a source of trivalent chromium such as trivalent chromium sulfate and water. In some embodiments, the coating solutions can be stabilized at any suitable pH such as 3.5 to 4.0. In some embodiments, the coating solutions can also be sufficiently stable so that the pH varies no more than ±0.15 while in storage for at least 20 days.

The trivalent chromium coating solution can be heated to any suitable temperature for any suitable amount of time. In some embodiments, the coating solution can be heated to at least 35° C. for no more than 24 hours.

The stabilized trivalent chromium coating solutions can include a number of other compounds. For example, the coating solutions can include a fluoride compound, a zirconate compound, a corrosion inhibitor compound, a chelating agent, a phosphorus compound, and/or a variety of other compounds.

It should be appreciated that the term "heat stabilized" is used to refer to chromium coating solutions that have been pH stabilized by heating the solution and adjusting the pH of the solution while it is hot. The term "storage" is used to refer to situations where the chromium coating solutions is not being used and is not undergoing pH adjustments by, for example, adding acidic or basic materials to the solutions.

There are other novel features and advantages that will become apparent as this specification proceeds. The summary is therefore provided to introduce a selection of concepts in a simplified form that are further described below in the detailed description; and the summary and the background are not intended to identify key concepts or essential aspects of the disclosed subject matter, nor should they be used to constrict or limit the scope of the claims. For example, the scope of the claims should not be limited based on whether the recited subject matter includes any or all aspects noted in the summary and/or addresses any of the issues noted in the background.

BRIEF DESCRIPTION OF THE DRAWINGS

The preferred and other embodiments are disclosed in association with the accompanying drawings in which.

DETAILED DESCRIPTION

Figure 1:
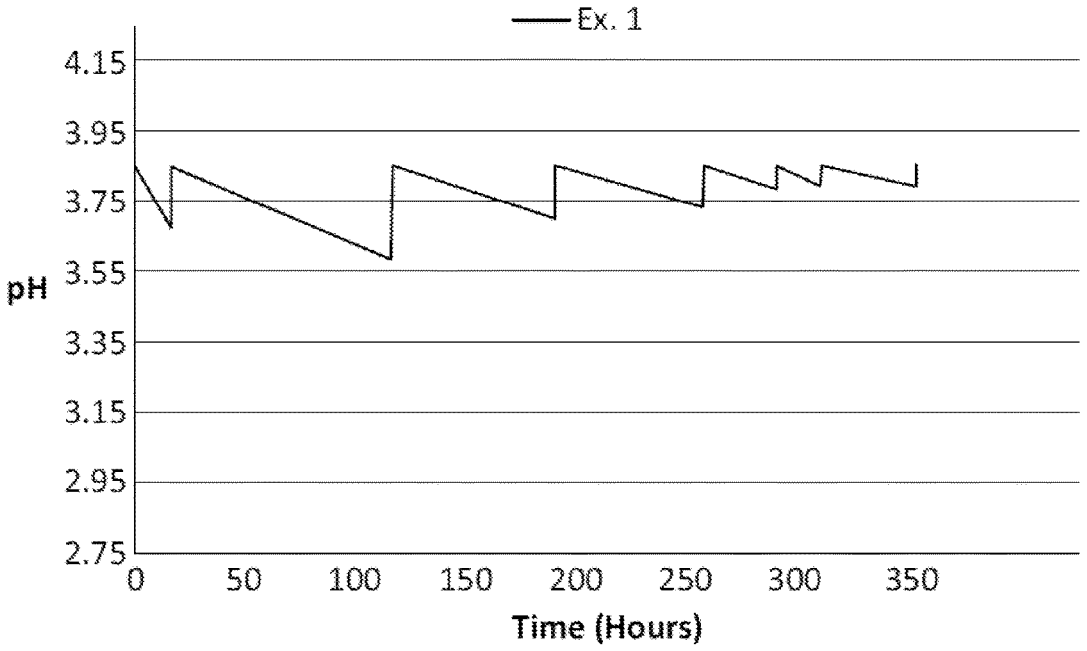
FIG. 1 is a graph showing the pH change over time of the conventional chromium coating solution prepared in Example 1.

A pH stable trivalent chromium coating solution is disclosed. The solution can be used for a variety of purposes. For example, the trivalent chromium coating solution can be used as a chromium conversion coating or as a sealant for anodized aluminum.

The trivalent chromium coating solution is storage stable meaning the pH of the solution is stable or approximately constant during storage. The pH of the solution doesn't vary significantly during storage like conventional trivalent chromium coating solutions. This is convenient because the end user can use the solution without first adjusting the pH.

pH Stabilization Process

In general, the process for stabilizing the pH of the trivalent chromium coating solution includes heating the trivalent chromium coating solution to an elevated temperature and adjusting the pH of the solution while it is at the elevated temperature. The pH is adjusted one or more times until it remains stable at the desired value. The solution is allowed to cool and the pH remains stable at the desired value indefinitely. The various aspects of the process are each described in greater detail as follows.

The process can be used to stabilize any suitable trivalent chromium coating solution. In some embodiments, the process is used to stabilize fully diluted, ready to use (RTU) trivalent chromium coating solutions. These are solutions that are ready to be applied to a metal surface such as aluminum, magnesium, zinc, or the like. The process can be used to stabilize the RTU solutions at the final pH level.

In other embodiments, the process is used to stabilize trivalent chromium concentrate solutions. These solutions are supplied to the end-user as a concentrate to make shipping, packaging, and storage more efficient. The user dilutes the concentrate with water to form the ready to use solution and then applies it to the surface that needs protection.

The concentrate solutions can be stabilized at a pH level that takes into account later dilution by the end user. For example, the concentrate solutions can be stabilized at a pH level lower than the final pH level so that when it is diluted with water to form the RTU solution, the pH level is at the final pH level.

The process can be used to stabilize trivalent chromium coating solutions having any suitable composition. A description is provided below of various compositions of suitable trivalent chromium coating solutions.

It should be noted, however, that the process is especially suitable for use with certain trivalent chromium coating solutions. For example, the process is especially suitable for stabilizing the compositions disclosed in the patent documents incorporated by reference at the end of the description. It is also especially suitable for stabilizing trivalent chromium coating solutions containing trivalent chromium sulfate as the source of trivalent chromium. It is also especially suitable for stabilizing trivalent chromium coating solutions containing the corrosion inhibitor compounds and/or the chelating agents described below.

The first step in the process is to heat the trivalent chromium coating solution to an elevated temperature. The coating solution can be heated to any suitable temperature that is capable of producing the desired pH stability. In one embodiment, the coating solution is heated to at least 35° C., at least 40° C., at least 45° C., at least 50° C., at least 55° C., or at least 60° C. In other embodiments, the coating solution is heated to no more than 100° C., no more than 95° C., or no more than 90° C.

The trivalent chromium coating solution can be heated using any suitable heat source and/or heating method. For example, the coating solution can be heated using a combustion heat source, an electrical heat source, a solar heat source, or the like. In one embodiment, the coating solution is heated to the desired temperature in a heated vessel.

With the trivalent chromium coating solution at the desired temperature, the next step in the process is to adjust the pH to the desired level. This is done by adding a basic material to raise the pH (or add a material that is more basic than the coating solution) or an acidic material to lower the pH of the solution (or add a material that is more acidic than the coating solution).

The pH of the coating solution typically tends to drop over time so a basic material is often added to increase the pH. Examples of suitable basic materials include hydroxides such as potassium hydroxide, sodium hydroxide, and ammonium hydroxide. In those situations where the pH is too high, an acidic material such as sulfuric acid can be added to the solution. The pH can be adjusted while the solution is actively mixed or without mixing.

The process of adjusting the pH of the coating solution can be a single step process that includes adding a given quantity of the basic or acidic material once or it can be an iterative process that includes repeatedly adding the basic or acidic material and measuring the pH until the solution reaches the desired pH value.

The process can be used to stabilize the pH of the trivalent chromium coating solution at any suitable pH value. If the coating solution is an RTU coating solution, then the pH is stabilized at the final use pH. Examples of such pHs are given below. If the coating solution is a concentrate solution, then the pH can be stabilized at a different value that, when diluted with water in preparation for being used, results in a solution having the desired final use pH.

In some embodiments, the trivalent chromium coating solution is stabilized at a final use pH of approximately 3.5 to approximately 4.0, approximately 3.6 to approximately 3.95, approximately 3.7 to approximately 3.9, or approximately 3.8 to 3.9. In other embodiments, the trivalent chromium coating solution is stabilized at a final use pH of at least approximately 3.5, at least approximately 3.6, at least approximately 3.7, or at least approximately 3.8. In other embodiments, the trivalent chromium coating solution is stabilized at a final use pH of no more than approximately 4.0, no more than approximately 3.95, or no more than approximately 3.9.

The trivalent chromium coating solution can be heated for any amount of time that is sufficient to stabilize the pH. For example, in some embodiments, the coating solution is heated for no more than 24 hours, no more than 18 hours, no more than 12 hours, no more than 8 hours, or no more than 4 hours.

After the pH of the trivalent chromium coating solution is stabilized, the next step in the process can be to cool the coating solution to ambient temperature. It should be appreciated that the coating solution can be cooled using any suitable device or process. For example, the coating solution can be passively cooled by letting it sit in the ambient environment. The coating solution can also be actively cooled using a cooling unit or device. In some preferred processes, the trivalent chromium coating solution is cooled by turning the heat source off and allowing the solution to passively cool to ambient temperature.

The trivalent chromium coating solution exhibits a high degree of pH stability. It can be stored for any suitable amount of time and then used without adjusting the pH because the pH is at the same level it was at the end of the stabilization process.

In some embodiments, the pH of the trivalent chromium coating solution varies no more than ±0.15, no more than ±0.1, no more than ±0.07, no more than ±0.05, or no more than ±0.03 while in storage for at least 7 days, at least 10 days, at least 14 days, at least 21 days, at least 30 days, at least 60 days, at least 90 days, at least 120 days, at least 1 year, or indefinitely. It should be noted that the recited time frame can begin immediately after the pH is adjusted, immediately after the heat is turned off, immediately after the trivalent chromium coating solution cools to ambient temperature, 24 hours after the trivalent chromium coating solution cools to ambient temperature, or any time after that.

Although the underlying mechanism is not fully known and because the inventors do not wish to be bound by theory, one potential explanation may be that the trivalent chromium undergoes hydrolysis and heating the solution accelerates the reaction. In any event, the reaction, whatever the mechanism, is completed by the time the solution is done heating and the last pH adjustment has been made so that the pH remains stable from that time forward.

The trivalent chromium coating solution can include a trivalent chromium compound and any of a number of other compounds or materials. Examples of suitable compounds include a fluoride compound, a zirconate compound, a corrosion inhibitor compound, and a chelating agent. Each of these is described in greater detail below.

Trivalent Chromium Compounds

The trivalent chromium compound can be any suitable trivalent chromium compound capable of forming a conversion coating on the metal substrate. Examples of suitable trivalent chromium compounds can be found in the patents incorporated by reference at the end of the description.

The trivalent chromium compound can be a water-soluble trivalent chromium compound such as a trivalent chromium salt. It is generally desirable to use chromium salts that provide anions that are not as corrosive as chlorides. Examples of such anions include nitrates, sulfates, phosphates, and acetates. In a preferred embodiment in some applications, the trivalent chromium compound is a trivalent chromium sulfate. Examples of such compounds include $Cr_2(SO_4)_3$, $(NR_4)Cr(SO_4)_2$, and $KCr(SO_4)_2$.

It should be appreciated that the conversion coating solution can include one or multiple trivalent chromium compounds. For example, in one embodiment, the conversion coating solution includes a single trivalent chromium compound. In another embodiment, the conversion coating solution includes two, three, four, or more trivalent chromium compounds.

The conversion coating solution can include any suitable quantity of the trivalent chromium compound. Examples of suitable quantities can be found in the patents incorporated by reference at the end of the description. In some embodiments, the conversion coating solution includes approximately 0.1 g/liter (0.01 wt %) to approximately 20 g/liter (2 wt %) of the trivalent chromium compound, approximately 0.2 g/liter (0.02 wt %) to approximately 10 g/liter (1 wt %) of the trivalent chromium compound, or approximately 0.5 g/liter (0.05 wt %) to approximately 8 g/liter (0.8 wt %) of the trivalent chromium compound.

In other embodiments, the conversion coating solution includes at least approximately 0.1 g/liter (0.01 wt %) of the trivalent chromium compound, at least approximately 0.2 g/liter (0.02 wt %) of the trivalent chromium compound, or at least approximately 0.5 g/liter (0.05 wt %) of the trivalent chromium compound. In still other embodiments, the conversion coating solution includes no more than 20 g/liter (2 wt %) of the trivalent chromium compound, no more than 10 g/liter (1 wt %) of the trivalent chromium compound, or no more than 8 g/liter (0.8 wt %) of the trivalent chromium compound.

Fluoride Compounds

The fluoride compound can be any suitable water-soluble fluoride compound that is capable of facilitating the formation of a protective coating on a substrate. In some embodiments, the fluoride compound includes at least four fluorine atoms and at least one atom of the following elements: zirconium, boron, silicon, aluminum, or titanium.

Examples of suitable fluoride compounds include alkali metal hexafluorozirconate compounds such as potassium hexafluorozirconate and sodium hexafluorozirconate; fluorozirconic acid; alkali metal tetrafluoroborates such as potassium tetrafluoroborate; alkali metal hexafluorosilicate such as potassium hexafluorosilicate; alkali metal hexafluorotitanate such as potassium hexafluorotitanate, and the like.

The chromium coating solution preferably includes a fluorozirconate compound. In some embodiments, the fluorozirconate compound is the only fluoride compound in the solution. In other embodiments, the solution includes the fluorozirconate compound and one or more additional fluoride compounds.

In some embodiments, the conversion coating solution comprises approximately 0.2 g/liter (0.02 wt %) to approximately 20 g/liter (2 wt %) of the fluoride compound, approximately 0.5 g/liter (0.05 wt %) to approximately 18 g/liter (1.8 wt %) of the fluoride compound, or approximately 1 g/liter (0.1 wt %) to approximately 15 g/liter (1.5 wt %) of the fluoride compound.

In some other embodiments, the conversion coating solution comprises at least approximately 0.2 g/liter (0.02 wt %) of the fluoride compound, at least approximately 0.5 g/liter (0.05 wt %) of the fluoride compound, or at least approximately 1 g/liter (0.1 wt %) of the fluoride compound. In yet other embodiments, the conversion coating solution comprises no more than approximately 20 g/liter (2 wt %) of the fluoride compound, no more than approximately 18.0 g/liter (1.8 wt %) of the fluoride compound, or no more than approximately 15 g/liter (1.5 wt %) of the fluoride compound.

Zirconate Compounds

The zirconate compound can be any suitable zirconate compound that is capable of facilitating the formation of a protective coating on a substrate. Examples of suitable zirconate compounds include fluorozirconate compounds such as those described above in connection with the fluoride compound—e.g., alkali metal hexafluorozirconate compounds such as potassium hexafluorozirconate, sodium hexafluorozirconate, and hexafluorozirconic acid.

The zirconate compound can be present in the same quantities as the fluoride compound. Accordingly the quantities disclosed above for the fluoride compound apply equally to the zirconate compound.

Corrosion Inhibitor Compounds

A corrosion inhibitor additive increases the corrosion resistance provided by the coating. Examples of suitable corrosion inhibitor compounds include 2-mercaptobenzothiazole (MBT), 2-mercaptobenzimidazole (MBI), 2-mercaptobenzoxazole (MBO) and/or benzotriazole (BTA). Other examples include any of those disclosed in the Chinese patent incorporated by reference at the end of the description. The addition of one or more corrosion inhibitor compounds can increase the corrosion resistance of the coating so that it satisfies the requirements of MIL-DTL-81706B Class 1A and Class 3 or the less stringent requirements of MIL-DTL-5541F Class 1A and Class 3.

It should be appreciated that although the corrosion inhibitor additive serves to substantially increase the coating's corrosion resistance, the coating can also satisfy the MIL corrosion resistance requirements even in the absence of such an additive. In general, the coating solution can meet any of the following industry specification and standards: MIL-DTL-81706B, MIL-DTL-5541F Type I & Type II, MIL-C-5541F Class 1A and Class 3, ROHS, REACH, WEEE, ELV, OSHA PEL, ASTM 3359, ASTM B921, QPL, EO 13148.

Chelating Agents

One or more chelating agents can be included in the trivalent chromium coating solution to help prevent precipitation. Any suitable chelating agents can be used. Examples of suitable chelating agents include 8-hydroxyquinoline, nitrilotris(methylene)triphosphonic acid (NTMP), and the like.

The chelating agent can be present in the conversion coating solution in any suitable amount. In some embodiments, the conversion coating solution comprises approximately 5 ppm to approximately 100 ppm of the chelating agent or approximately 10 ppm to approximately 30 ppm of the chelating agent. In other embodiments, the conversion coating solution comprises at least approximately 5 ppm of the chelating agent or at least approximately 10 ppm of the chelating agent. In still other embodiments, the conversion coating solution comprises no more than approximately 100 ppm of the chelating agent or no more than 30 ppm of the chelating agent.

Phosphorous Compounds

The trivalent chromium conversion coating solution can also include a phosphorous compound that further enhances corrosion protection of the metal substrate. The improved corrosion protection is provided by adsorption of phosphonate groups from an organic amino-phosphonic acid compound on a surface of the metal substrate to form a M-O-P covalent bond and subsequent formation of a network hydrophobic layer over any active corrosion site on the metal substrate.

Examples of suitable phosphorous compounds include derivatives of amino-phosphonic acids such as the salts and esters of nitrilotris(methylene)triphosphonic acid (NTMP), hydroxy-, amino-alkylphosphonic acids, ethylimido(methylene)phosphonic acids, diethylaminomethylphosphonic acid, and the like. Preferably, the derivative is, in at least some instances, soluble in water. A particularly suitable phosphorous compound for use as a corrosion inhibitor and solution stabilizer is nitrilotris(methylene)triphosphonic acid (NTMP).

Other Compounds

The trivalent chromium conversion coating solution can also include other compounds or materials such as thickeners, surfactants, and the like. Examples of these materials can be found in the patents incorporated by reference at the end of the description. These materials can be included in the trivalent chromium conversion coating solution in any of the quantities disclosed in the patents.

Methods of Use

The trivalent chromium coating solution can be used to coat a variety of substrates such as bare aluminum and anodized aluminum, zinc and zinc alloys, magnesium, galvanized steel, IVD, cadmium, silver, brass, titanium, stainless steel, iron alloys, and zirconium.

The trivalent chromium coating solution can be used for a variety of purposes. For example, it can be used for extended corrosion resistance, increase paint adhesion, modify electrical properties, and increase surface durability. It is also temperature resistant so it can be dried at temperatures exceeding 800° F. or baked for hydrogen relief in excess of 500° F. for 24 hours without loss of performance.

The trivalent chromium coating solution can be used in a variety of applications. Examples include chemical conversion coating applications, anodized aluminum sealer applications, and passivate and anti-tarnish applications. The trivalent chromium coating solution can also be applied in any of a number of ways including by immersion, spraying, touch-up pen, or the like.

EXAMPLES

The following examples are provided to further illustrate the disclosed subject matter. They should not be used to constrict or limit the scope of the claims in any way.

Example 1

The pH stability of a conventional chromium coating solution was evaluated as follows. A chromium coating solution or bath was prepared by mixing 3 liters of deionized water and 1 liter of trivalent chromium concentrate (e.g., CHEMEON TCP-HF®) in a glass beaker equipped with magnetic mixing. The initial pH of the trivalent chromium concentrate was 2.78. The pH of the chromium coating solution was measured and adjusted over an approximately 352 hour period of time. The pH was adjusted dropwise using freshly prepared 10.0% w/v NaOH (9.9996 g NaOH in 100 ml volumetric flask) while mixing the solution.

Table 1 shows that the pH of the solution dropped over the entire duration of the test. The pH initially dropped at a rapid rate over the first approximately 16 hours of the test. After that, the pH dropped at a relatively consistent rate for the duration of the test. The pH was periodically adjusted back to 3.85 by adding NaOH solution. FIG. 1 is a chart of the data in Table 1.

The results show the typical unstable behavior of a conventional chromium coating solution. The effectiveness of the chromium coating solution depends greatly on the pH of the solution at the time of application. However, as the results show, the pH of the solution varied significantly over time. If the pH wasn't adjusted periodically, it would have gone much lower making the solution even less suitable for coating applications. In practice, the user must measure the pH of the solution and adjust it accordingly before each application.

TABLE 1

Chromium Coating Solution #1 pH Adjustments over Time (Conventional 4 liter test)

| | pH | pH | pH Change | | | |
|---|---|---|---|---|---|---|
| Hours | (initial) | (final) | Amount | Rate (Amt/hr) | NaOH Added | Temperature |
| 0 | 3.13 | | | | | 19.4° C. (67° F.) |
| 0.25 | | 3.85 | | | 4.4 ml | |
| 16.58 | 3.67 | | −0.18 | −0.011023 | | 18.3° C. (65° F.) |
| 16.83 | | 3.85 | | | 1.2 ml | |
| 116.33 | 3.58 | | −0.27 | −0.002714 | | Ambient (Not Recorded) |
| 116.58 | | 3.85 | | | 1.35 ml | |
| 189.58 | 3.70 | | −0.15 | −0.002055 | | 22.2° C. (72° F.) |
| 189.83 | | 3.85 | | | 0.73 ml | |
| 256.58 | 3.73 | | −0.12 | −0.001798 | | 21.1° C. (70° F.) |
| 256.83 | | 3.85 | | | 0.54 ml | |

TABLE 1-continued

| Chromium Coating Solution #1 pH Adjustments over Time (Conventional 4 liter test) | | | | | | |
|---|---|---|---|---|---|---|
| | pH | pH | pH Change | | | |
| Hours | (initial) | (final) | Amount | Rate (Amt/hr) | NaOH Added | Temperature |
| 289.75 | 3.78 | | −0.07 | −0.002126 | | 21.1° C. (70° F.) |
| 290 | | 3.85 | | | 0.23 ml | |
| 309.75 | 3.79 | | −0.06 | −0.003038 | | 22.2° C. (72° F.) |
| 310 | | 3.85 | | | 0.27 ml | |
| 352.33 | 3.79 | — | −0.06 | −0.001417 | | 18.9° C. (66° F.) |
| 352.58 | — | 3.85 | | | 0.23 ml | |

Example 2

The pH stability of another conventional chromium coating solution was evaluated. The procedure was the same as in Example 1 except the test duration was approximately 124 hours and the solution was prepared by mixing 1.5 liters of deionized water and 500 ml of trivalent chromium concentrate. The initial pH of the trivalent chromium concentrate was 2.55.

Figure 2:
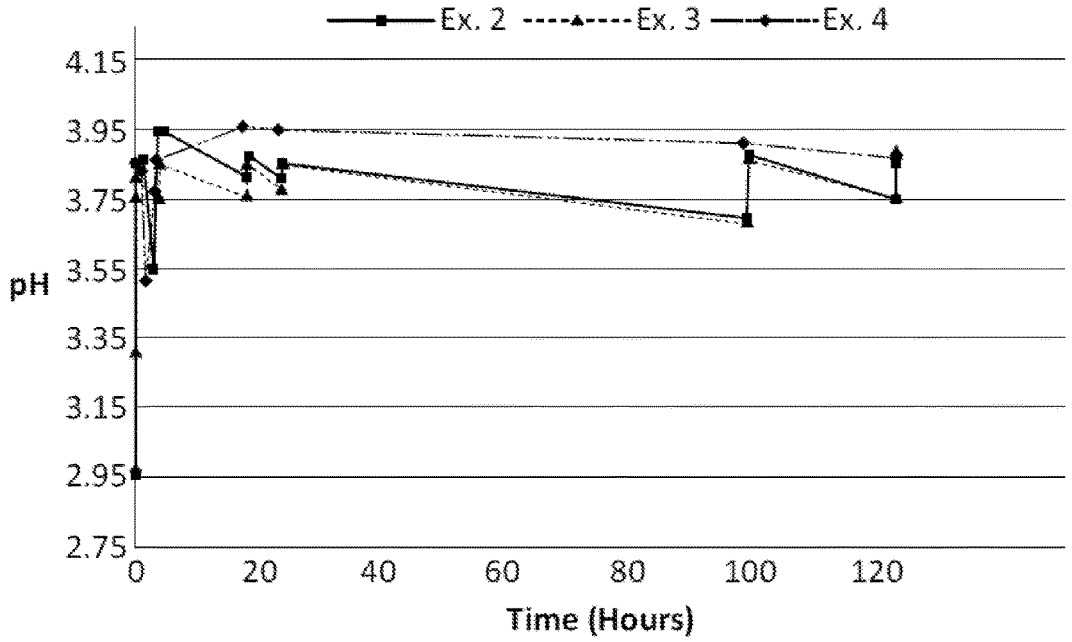
FIG. 2 is a graph showing the pH change over time of: (a) the conventional chromium coating solution prepared in Example 2, (b) the chromium coating solution comprising dissolved aluminum prepared in Example 3, and (c) the heat stabilized chromium coating solution prepared in Example 4.

Table 2 shows that the solution exhibited unstable behavior for the entire duration of the test. The pH dropped between all the measurement intervals except one where it increased. The results confirm that the pH of the conventional chromium coating solution is unstable and must be measured and adjusted before each application. FIG. 2 is a chart that contains the data in Table 2. FIG. 2 also contains the data from Examples 3 and 4 for comparison purposes.

TABLE 2

| Chromium Coating Solution #2 pH Adjustments over Time (Conventional 2 liter test) | | | | | | |
|---|---|---|---|---|---|---|
| | pH | pH | pH Change | | | |
| Hours | (initial) | (final) | Amount | Rate (Amt/hr) | NaOH Added | Temperature |
| 0 | 2.96 | | | | | 21.1° C. (70° F.) |
| 0.25 | | 3.85 | | | 3.3 ml | |
| 1 | 3.75 | | −0.10 | −0.133333 | | 21.1° C. (70° F.) |
| 1.25 | | 3.86 | | | 0.42 ml | |
| 2.95 | 3.55 | | −0.31 | −0.182353 | | 20.5° C. (69° F.) |
| 3.2 | | 3.85 | | | 1.08 ml | |
| 3.78 | 3.94 | | 0.09 | 0.155172 | | 19.4° C. (67° F.) |
| 4.03 | | 3.94 | | | — | |
| 18.08 | 3.81 | | −0.13 | −0.009253 | | 18.3° C. (65° F.) |
| 18.33 | | 3.87 | | | 0.15 ml | |
| 23.67 | 3.81 | | −0.06 | −0.011236 | | 18.9° C. (66° F.) |
| 23.92 | | 3.85 | | | 0.23 ml | |
| 99.17 | 3.69 | | −0.16 | −0.002126 | | 22.8° C. (73° F.) |
| 99.42 | | 3.87 | | | 0.39 ml | |
| 123.33 | 3.75 | | −0.12 | −0.005019 | | 22.2° C. (72° F.) |
| 123.59 | | 3.85 | | | 0.27 ml | |

Example 3

The pH stability of a chromium coating solution containing dissolved aluminum was tested to determine whether the dissolved aluminum affected the pH stability. The procedure was the same as in Example 2 except two 3 in×4 in aluminum alloy coupons (1100H14) were cleaned, rinsed, and placed in the solution for 4.5 hours to provide a source of dissolved aluminum. pH adjustments were made while the aluminum was in the solution and after it was removed from the solution. The total amount of aluminum dissolved in the solution was 28.7 mg (or 14.4 mg/kg (ppm)).

Table 3 shows that the aluminum in the solution did not substantively change its pH stability. The pH dropped steadily and significantly over the duration of the test. FIG. 2 is a chart that contains the data in Table 3. FIG. 2 also contains the data from Examples 2 and 4 for comparison purposes.

TABLE 3

Chromium Coating Solution #3 pH Adjustments over Time (Dissolved Aluminum)

| Hours | pH (initial) | pH (final) | pH Change Amount | pH Change Rate (Amt/hr) | NaOH Added | Temperature |
|---|---|---|---|---|---|---|
| 0 | 3.31 | | | | | 22.8° C. (73° F.) |
| 0.25 | | 3.85 | | | 2.7 ml | |
| 0.93 | 3.80 | | −0.05 | −0.073529 | | — |
| 1.18 | | 3.86 | | | 0.23 ml | |
| 3.7 | 3.75 | | −0.11 | −0.043651 | | — |
| 3.95 | | 3.85 | | | 0.19 ml | |
| 18 | 3.76 | | −0.09 | −0.006406 | | 18.9° C. (66° F.) |
| 18.25 | | 3.85 | | | 0.31 ml | |
| 23.63 | 3.78 | | −0.07 | −0.013011 | | — |
| 23.88 | | 3.85 | | | 0.27 ml | |
| 99.12 | 3.68 | | −0.17 | −0.002259 | | 23.3° C. (74° F.) |
| 99.37 | | 3.86 | | | 0.46 ml | |
| 123.25 | 3.75 | | −0.11 | −0.004606 | | 22.2° C. (72° F.) |
| 123.5 | | 3.88 | | | 0.31 ml | |

Example 4

Heating a chromium coating solution was tested to determine whether it affected the pH stability of the solution. The procedure was the same as in Example 2 except the solution was heated to 50-55° C., the pH was adjusted twice over a period of 1.5 to 2 hours, the heat was turned off, and the solution was left to cool to ambient temperature overnight.

Table 4 shows that heating the solution before adjusting the pH appears to stabilize it FIG. 2 is a chart that contains the data in Table 4 as well as the data from Examples 2 and 3. FIG. 2 shows that heating the solution produced a significantly more stable solution. The pH stability produced by heating the solution was tested further in Examples 5-8 below.

TABLE 4

Chromium Coating Solution #4 pH Adjustments over Time (Heated Bath #1)

| Hours | pH (initial) | pH (final) | pH Change Amount | pH Change Rate (Amt/hr) | NaOH Added | Temperature |
|---|---|---|---|---|---|---|
| 0 | 2.97 | | | | | 51° C. (124° F.) |
| 0.25 | | 3.85 | | | 6.29 ml | |
| 1.62 | 3.51 | | −0.34 | −0.248175 | | 55° C. (131° F.) |
| 1.87 | | 3.85 | | | 1.16 ml | (heat turned off) |
| 3 | 3.77 | | −0.08 | −0.070796 | | 33.2° C. (92° F.) |
| 3.25 | | 3.86 | | | 0.27 ml | |
| 17.33 | 3.96 | 3.96 | 0.10 | 0.007102 | — | 17.8° C. (64° F.) |
| 22.95 | 3.95 | 3.95 | −0.01 | −0.001862 | — | — |
| 98.45 | 3.91 | 3.91 | −0.04 | −0.000532 | — | 21.7° C. (71° F.) |
| 122.45 | 3.87 | 3.87 | −0.04 | −0.001684 | — | 20.6° C. (69° F.) |

Example 5

The pH stability of a heat stabilized chromium coating solution was tested. The chromium coating solution or bath was prepared by mixing 3.6 liters of deionized water and 1.4 liters of trivalent chromium concentrate (e.g., CHEMEON TCP-HF®) in a glass beaker equipped with magnetic mixing. The solution was heated to 50-55° C. before the pH was adjusted. Once the solution was at the desired temperature, the pH was adjusted three times to 3.80 or 3.81 over the course of 1.5 to 2 hours. The pH was adjusted dropwise using the NaOH solution in Example 1 while mixing the solution. After adjusting the pH, the heat was turned off and the solution was allowed to cool to ambient temperature (room temperature) overnight.

Figure 3:
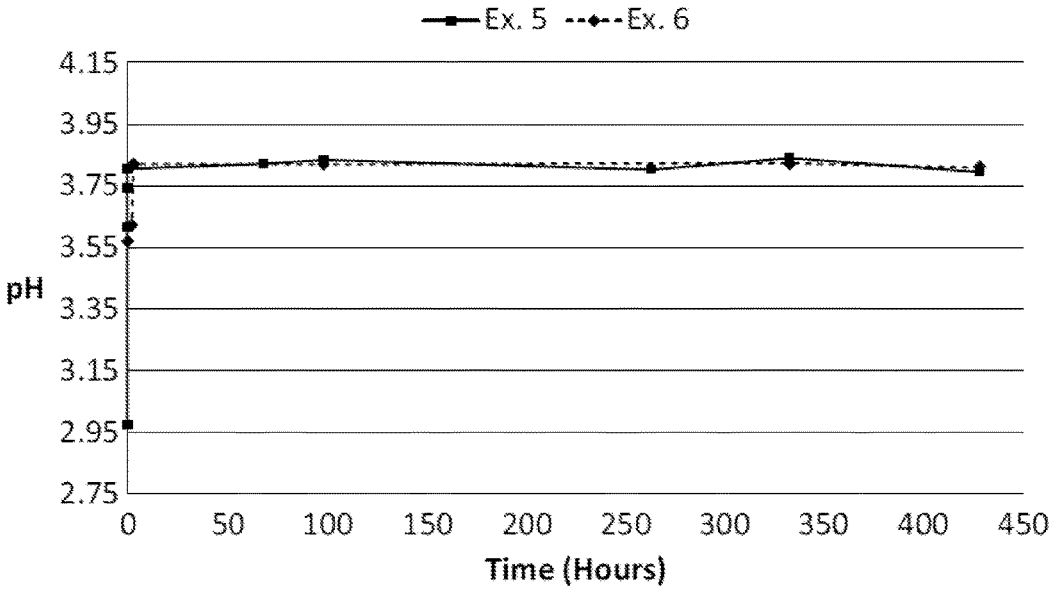
FIG. 3 is a graph showing the pH change over time of the heat stabilized chromium coating solutions prepared in Examples 5 and 6.

The cooled solution was used to coat five aluminum test coupons in the manner described below. After the coating process was complete, the pH was measured over the next approximately 428 hours to evaluate the pH stability of the solution. Table 5 and FIG. 3 show that the solution was much more stable than those tested in Examples 1-3. The last pH adjustment set the pH of the solution at 3.81. The pH did not vary from the set amount by more than ±0.02 over the next approximately 428 hours.

TABLE 5

| Chromium Coating Solution #5 pH Adjustments over Time (Heated Bath #2) | | | | | | |
|---|---|---|---|---|---|---|
| | pH | pH | pH Change | | | |
| Hours | (initial) | (final) | Amount | Rate (Amt/hr) | NaOH Added | Temperature |
| 0 | 2.97 | | | | | 52° C. (125.6° F.) |
| 0.25 | | 3.80 | | | 17.4 ml | |
| 0.97 | 3.61 | | −0.19 | −0.263889 | | 53° C. (127.4° F.) |
| 1.22 | | 3.80 | | | 2.78 ml | |
| 1.61 | 3.74 | | −0.06 | −0.153846 | | 50° C. (122° F.) |
| 1.86 | | 3.81 | | | 1.39 ml | (heat turned off) |
| 67.67 | 3.82 | 3.82 | 0.01 | 0.000152 | — | 21° C. (70° F.) |
| 97.6 | 3.83 | 3.83 | 0.01 | 0.000337 | — | 20.6° C. (69° F.) |
| 262.67 | 3.80 | 3.80 | −0.03 | −0.000182 | — | — |
| 331.42 | 3.83 | 3.83 | 0.03 | 0.000438 | — | — |
| 427.25 | 3.80 | 3.80 | −0.03 | −0.000314 | — | — |

As mentioned above, the chromium coating solution was used to coat five 2024-T3 aluminum alloy test coupons (3 in×10 in) for corrosion resistance per MIL-DTL-81706B Type II Class 1A requirements. Each test coupon was processed using the following steps and processing parameters performed in sequence.

1. Coupons were cleaned using solvent wipes (70.0% isopropyl alcohol).
2. Coupons were cleaned using CHEMEON Cleaner 1000 (6 minutes, 120° F.).
3. Coupons were rinsed with tap water (1 minute, overflowing, room temperature).
4. Coupons were rinsed with deionized water (1 minutes, overflowing, room temperature).
5. Coupons were submerged in 50.0% tech. grade nitric acid (1 minutes, room temperature).
6. Coupons were rinsed with tap water (1 minute, overflowing, room temperature).
7. Coupons were rinsed with deionized water (1 minutes, overflowing, room temperature).
8. Coupons were submerged in the chromium coating solution (5 minutes, 74.0° F., pH 3.81, stagnant).
9. Coupons were rinsed with deionized water (30 seconds, overflowing, room temperature).
10. Coupons were air dried at room temperature.
11. Coupons were cured at room temperature for 40 hours.

The corrosion resistance of the five test coupons was evaluated using a salt spray test. The edges of the coupons were waxed and placed into a neutral salt spray chamber maintained in accordance with ASTM B 117 for 168 hours. The results of the salt spray test are shown below in Table 6. None of the test coupons had any pits.

TABLE 6

| 168-Hour Salt Spray Results | |
|---|---|
| 2024-T3 Al Alloy Coupon (3 in × 10 in) | No. of Pits |
| 1 | 0 |
| 2 | 0 |
| 3 | 0 |
| 4 | 0 |
| 5 | 0 |

Example 6

The pH stability of another heat stabilized chromium coating solution was tested. The chromium coating solution or bath was prepared by mixing 2.88 liters of deionized water and 1.12 liters of trivalent chromium concentrate (e.g., CHEMEON TCP-HF®) in a glass beaker equipped with magnetic mixing. The solution was heated to 50-55° C. before the pH was adjusted. Once the solution was at the desired temperature, the pH was adjusted three times to 3.80 or 3.82 over the course of 1.5 to 2 hours. The pH was adjusted dropwise using the NaOH solution in Example 1 while mixing the solution. After adjusting the pH, the heat was turned off and the solution was allowed to cool to ambient temperature overnight.

The solution was stored in a 1-gallon plastic container to determine how this would affect the pH stability. The pH was measured over an approximately 428 hour period of time. Table 7 and FIG. 3 show that the solution was extraordinarily stable compared to the conventional chromium coating solutions tested in Examples 1-3. The last pH adjustment set the pH of the solution at 3.82. The pH did not vary at all for the first approximately 330 hours and then only varied by −0.01 when the last measurement was made at approximately 428 hours.

TABLE 7

| Chromium Coating Solution #6 pH Adjustments over Time (Heated Bath #3) | | | | | | |
|---|---|---|---|---|---|---|
| | pH | pH | pH Change | | | |
| Hours | (initial) | (final) | Amount | Rate (Amt/hr) | NaOH Added | Temperature |
| 0 | 2.97 | | | | | 50° C. (122° F.) |
| 0.25 | | 3.80 | | | 12.4 ml | |
| 1 | 3.57 | | −0.23 | −0.294872 | | 56° C. (133° F.) |
| 1.28 | | 3.80 | | | 2.9 ml | |
| 1.87 | 3.62 | | −0.18 | −0.305085 | | 51° C. (124° F.) |
| 2.12 | | 3.82 | | | 1.39 ml | (heat turned off) |
| 67.8 | 3.82 | 3.82 | 0 | 0 | — | 21° C. (70° F.) |

TABLE 7-continued

| Chromium Coating Solution #6 pH Adjustments over Time (Heated Bath #3) | | | | | | |
|---|---|---|---|---|---|---|
| | pH | pH | pH Change | | | |
| Hours | (initial) | (final) | Amount | Rate (Amt/hr) | NaOH Added | Temperature |
| 97.75 | 3.82 | 3.82 | 0 | 0 | — | 20.6° C. (69° F.) |
| 331.6 | 3.82 | 3.82 | 0 | 0 | — | — |
| 427.4 | 3.81 | 3.81 | −0.01 | −0.000105 | — | — |

Example 7

The stability of the trivalent chromium concentration in a pH stabilized chromium coating solution was tested. The pH was stabilized using the heat treatment process described in Examples 4-6. Previous experience indicated that the concentration of trivalent chromium in the pH stabilized chromium coating solutions may drop over time (e.g., 25% to 17% in 6 months) due to precipitation. The following factors were evaluated to determine whether they had an effect on the trivalent chromium concentration of the solution, specifically, whether they prevent precipitation of the trivalent chromium: material used to hold the solutions and the presence of chelating agents in the solution.

The following samples were prepared from a single batch of pH stabilized trivalent chromium coating solution. One sample was stored in plastic before filtering off precipitate. Another sample was stored in plastic after filtering off the precipitate. Another sample was stored in glass after filtering off the precipitate. Two samples, one filtered and one unfiltered, had 23 ppm of the chelating agent 8-hydroxyquinoline (8HQ) added. Two other samples, one filtered and one unfiltered, had 23 ppm of nitrilotris(methylene)triphosphonic acid (NTMP) added. The chelating agents were added to chelate any free metals and prevent further precipitation.

Figure 4:
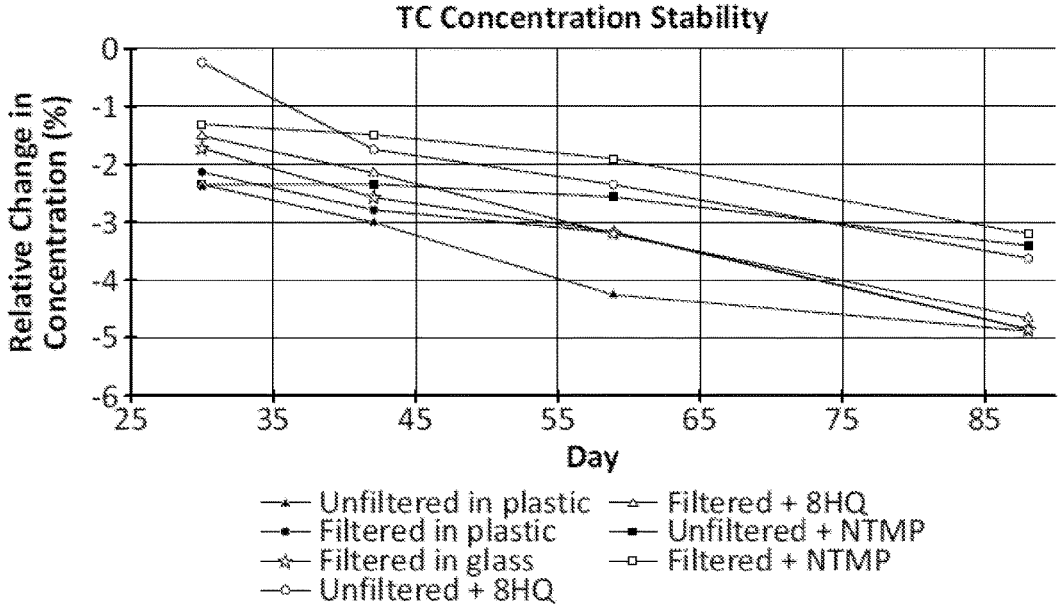
FIG. 4 is a graph showing the change in the concentration of trivalent chromium in a pH stabilized chromium coating solution over time.
Figure 5:
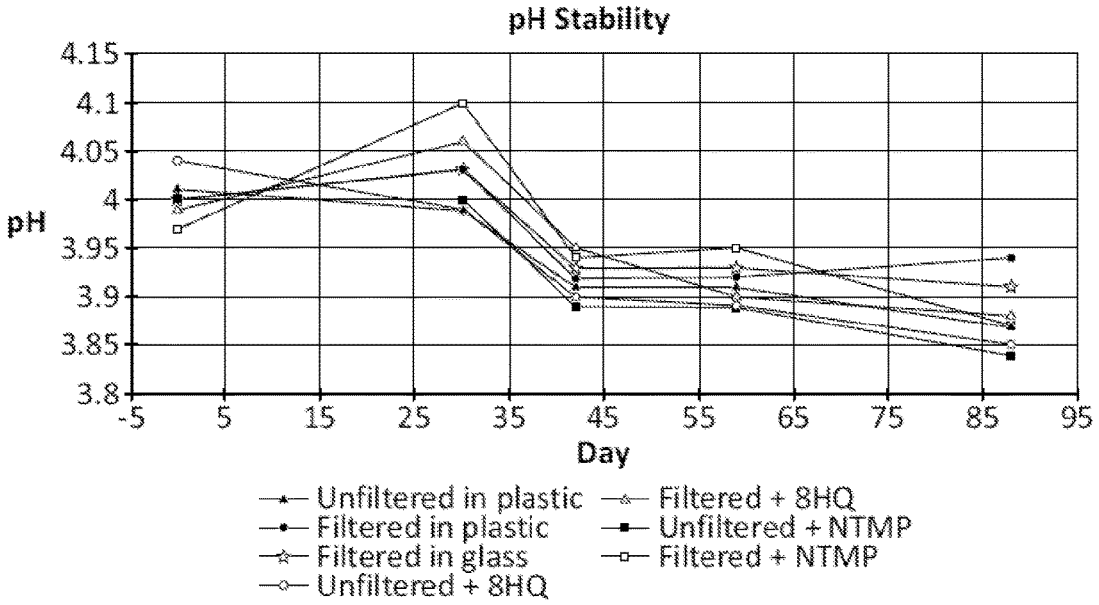
FIG. 5 is a graph showing the change in pH over time of the pH stabilized chromium coating solutions shown in FIG. 4.

The concentration of trivalent chromium (TC) and pH of the samples were measured periodically. The results are shown below in Table 8. Overall, the concentration of trivalent chromium in every sample dropped by at >3% in ~8 weeks. The sample stored in glass and the sample containing 8HQ showed the highest trivalent chromium concentrations and the least visible precipitate. A graph of these concentrations over time is shown in FIG. 4. A graph of the pH values over time is shown in FIG. 5. A comparison of the filtered sample with 8HQ and NTMP at day 59 showed a clearly visible decrease of precipitate using the 8HQ compared to the NTMP.

TABLE 8

| Trivalent Chromium Concentration and pH Stability Results | | | | | | | | | | |
|---|---|---|---|---|---|---|---|---|---|---|
| | Start | | 4 Weeks | | 6 Weeks | | 8.5 Weeks | | 12.5 Weeks | |
| Sample | TC (%) | pH | TC (%) | pH | TC (%) | pH | TC (%) | pH | TC (%) | pH |
| Plastic (unfiltered) | 26.50 | 4.01 | 24.17 | 3.99 | 23.54 | 3.91 | 22.27 | 3.91 | 21.63 | 3.87 |
| Plastic (filtered) | 27.13 | 4.00 | 25.02 | 4.03 | 24.38 | 3.92 | 23.96 | 3.92 | 22.27 | 3.94 |
| Glass (filtered) | 27.13 | 4.00 | 25.44 | 4.03 | 24.59 | 3.93 | 23.96 | 3.93 | 22.27 | 3.91 |
| 8HQ (unfiltered) | 26.29 | 4.04 | 26.08 | 3.99 | 24.59 | 3.90 | 23.96 | 3.89 | 22.69 | 3.85 |
| 8HQ (filtered) | 26.71 | 3.99 | 25.23 | 4.06 | 24.59 | 3.95 | 23.54 | 3.90 | 22.05 | 3.88 |
| NTMP (unfiltered) | 25.86 | 4.00 | 23.54 | 4.00 | 23.54 | 3.89 | 23.32 | 3.89 | 22.48 | 3.84 |
| NTMP (filtered) | 24.59 | 3.97 | 23.32 | 4.10 | 23.11 | 3.94 | 22.69 | 3.95 | 21.42 | 3.87 |

Example 8

The following samples were prepared from a single batch of pH stabilized trivalent chromium coating solution. Two samples, one filtered and one unfiltered, were stored in plastic after filtering off the precipitate. Two samples, one filtered and one unfiltered, were stored in glass after filtering off the precipitate. Two samples, one filtered and one unfiltered, had 5 ppm of 8HQ added.

Figure 6:
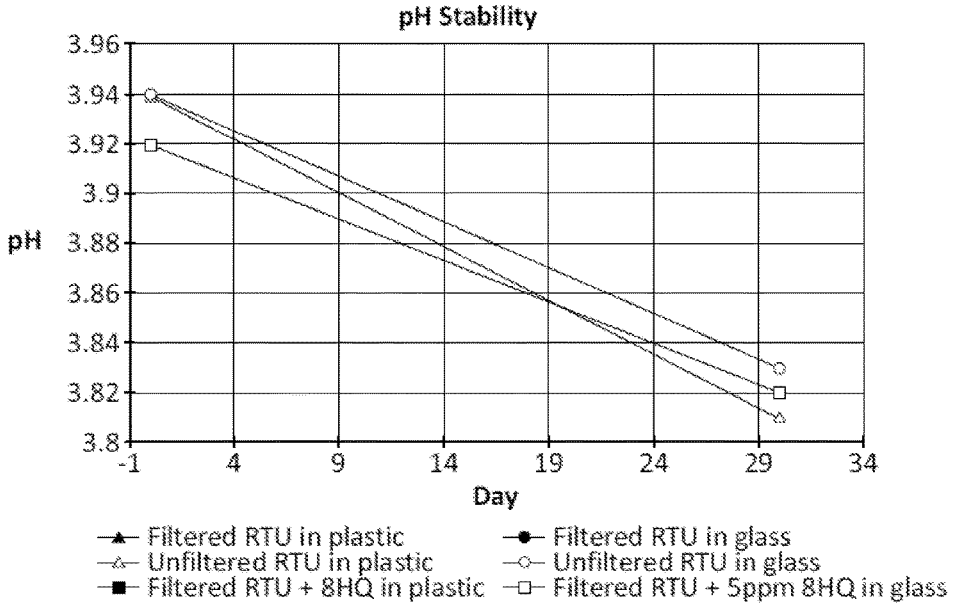
FIG. 6 is a graph showing the change in the pH of a pH stabilized chromium coating solution over time.

The concentration of trivalent chromium (TC) and pH of the samples were measured at the start and after four weeks. The results are shown below in Table 9 and FIG. 6. The concentration of trivalent chromium in every sample dropped as did the pH of the solution.

TABLE 9

| Trivalent Chromium Concentration and pH Stability Results | | | | |
|---|---|---|---|---|
| | Start | | 4 Weeks | |
| Sample | TC (%) | pH | TC (%) | pH |
| Plastic (unfiltered) | 42.59 | 3.94 | 37.08 | 3.81 |
| Glass (unfiltered) | 42.59 | 3.94 | 36.87 | 3.83 |
| Plastic (filtered) | 42.16 | 3.94 | 38.14 | 3.83 |
| Glass (filtered) | 41.95 | 3.94 | 38.14 | 3.82 |
| 8HQ (unfiltered) | 42.16 | 3.92 | 38.35 | 3.82 |
| 8HQ (filtered) | 42.37 | 3.92 | 37.72 | 3.82 |

Example 9

A trivalent chromium coating solution is stabilized by following one or more of the following steps:

1. Dilute a trivalent chromium concentrate such as CHEMEON TCP-HF® to 25.0-30.0% v/v with deionized water (28% preferred in some instances).
2. While mixing, heat the chromium coating solution to 55° C.±5° C. (50-60° C.). The solution may be mixing at 50-60° C. during the entire pH adjustment blend period (1.5-3 hours).
3. Adjust the pH of the solution to 3.85-3.90 using a dilute base such as NaOH, KOH, or the like using continuous mixing.
4. Check the pH every 30-60 minutes and readjust the pH to 3.85-3.90 as necessary while mixing using the dilute base.
5. After roughly 2 hours of heated mixing and pH adjustment, a final pH adjustment should be made before turning off the heat. Typically, 3-4 pH adjustments have been made while heating the solution.
6. Allow solution to cool to room temperature (overnight sometimes preferred).
7. Filter the solution using 8-20 μm filter paper. Dispose the green precipitate collected in filter.
8. Check the concentration and pH of the filtered solution. The concentration should be ±2.0% of the original concentration (26-30% for a 28.0% v/v bath). If concentration is high from evaporation, add deionized water while mixing until desired concentration is reached. The pH should be between 3.75-3.95 (3.80-3.90 preferred in some embodiments).

ILLUSTRATIVE EMBODIMENTS

Reference is made in the following to several illustrative embodiments of the disclosed subject matter. The following embodiments illustrate only a few selected embodiments that may include one or more of the various features, characteristics, and advantages of the disclosed subject matter. Accordingly, the following embodiments should not be considered as being comprehensive of all possible embodiments.

In one embodiment, a method of stabilizing a chromium coating solution comprises: heating the chromium coating solution; and adjusting the pH of the chromium coating solution while heating the chromium coating solution. The chromium coating solution can comprise water. The chromium coating solution can be free or substantially free of hexavalent chromium.

In some embodiments, the method comprises heating the chromium coating solution to at least 35° C., at least 40° C., at least 45° C., or at least 50° C. The method can comprise heating the chromium coating solution for no more than 24 hours, no more than 18 hours, no more than 12 hours, no more than 8 hours, or no more than 4 hours.

In some embodiments, adjusting the pH of the chromium coating solution comprises adding a material that is more basic (e.g., hydroxides such as potassium hydroxide, sodium hydroxide, and/or ammonium hydroxide) or more acidic (e.g., acids such as sulfuric acid) than the chromium coating solution to raise or lower the pH of the chromium coating solution. Adjusting the pH of the chromium coating solution can comprise repeatedly adding one or more materials that is more basic or more acidic than the chromium coating solution to raise or lower the pH of the chromium coating solution. Adjusting the pH of the chromium coating solution can comprise adding an alkaline material to the chromium coating solution to raise the pH of the chromium coating solution.

In some embodiments, the pH of the chromium coating solution varies no more than ±0.15 while in storage for at least 7 days, at least 10 days, at least 14 days, at least 21 days, at least 30 days, at least 60 days, at least 90 days, at least 120 days, or at least 1 year (the recited days or year can begin immediately after the pH is adjusted, immediately after the heat is turned off, immediately after the chromium coating solution cools to ambient temperature, 24 hours after the chromium coating solution cools to ambient temperature, or any time after that).

In some embodiments, the pH of the chromium coating solution varies no more than ±0.1 while in storage for at least 7 days, at least 10 days, at least 14 days, at least 21 days, at least 30 days, at least 60 days, at least 90 days, at least 120 days, or at least 1 year (the recited days or year can begin immediately after the pH is adjusted, immediately after the heat is turned off, immediately after the chromium coating solution cools to ambient temperature, 24 hours after the chromium coating solution cools to ambient temperature, or any time after that).

In some embodiments, the pH of the chromium coating solution varies no more than ±0.07 while in storage for at least 7 days, at least 10 days, at least 14 days, at least 21 days, at least 30 days, at least 60 days, at least 90 days, at least 120 days, or at least 1 year (the recited days or year can begin immediately after the pH is adjusted, immediately after the heat is turned off, immediately after the chromium coating solution cools to ambient temperature, 24 hours after the chromium coating solution cools to ambient temperature, or any time after that).

In some embodiments, the pH of the chromium coating solution varies no more than ±0.05 while in storage for at least 7 days, at least 10 days, at least 14 days, at least 21 days, at least 30 days, at least 60 days, at least 90 days, at least 120 days, or at least 1 year (the recited days or year can begin immediately after the pH is adjusted, immediately after the heat is turned off, immediately after the chromium coating solution cools to ambient temperature, 24 hours after the chromium coating solution cools to ambient temperature, or any time after that).

In some embodiments, the pH of the chromium coating solution varies no more than ±0.03 while in storage for at least 7 days, at least 10 days, at least 14 days, at least 21 days, at least 30 days, at least 60 days, at least 90 days, at least 120 days, or at least 1 year (the recited days or year can begin immediately after the pH is adjusted, immediately after the heat is turned off, immediately after the chromium coating solution cools to ambient temperature, 24 hours after the chromium coating solution cools to ambient temperature, or any time after that).

In some embodiments, the method comprises adjusting the pH of the chromium coating solution to 3.5 to 4.0 (3.6 to 3.95, 3.7 to 3.9, or 3.75 to 3.87) while the chromium solution is at the elevated temperature. The method can comprise mixing the chromium coating solution while adjusting the pH. The method can comprise filtering precipitates from the chromium coating solution after adjusting the pH. The method can comprise cooling the chromium coating solution. The method can comprise mixing the chromium coating solution while the chromium coating solution cools. The method can comprise cooling the chromium coating solution to ambient temperature and mixing the chromium coating solution while it is at ambient temperature.

In another embodiment, a chromium coating solution can be produced by any of the processes described above.

In another embodiment, a heat stabilized chromium coating solution is disclosed. The heat stabilized chromium coating solution can be free or substantially free of hexavalent chromium.

In another embodiment, a chromium coating solution comprises: trivalent chromium; and water; wherein the chromium coating solution has a pH of 3.5 to 4.0; and wherein the pH of the chromium coating solution varies no more than ±0.15 while in storage for at least 7 days. The chromium coating solution can be free or substantially free of hexavalent chromium.

In some embodiments, the pH of the chromium coating solution varies no more than ±0.15 while in storage for at least 10 days, at least 14 days, at least 21 days, at least 30 days, at least 60 days, at least 90 days, at least 120 days, or at least 1 year. The pH of the chromium coating solution can vary no more than ±0.1 while in storage for at least 7 days, at least 10 days, at least 14 days, at least 21 days, at least 30 days, at least 60 days, at least 90 days, at least 120 days, or at least 1 year.

In some embodiments, the pH of the chromium coating solution varies no more than ±0.07 while in storage for at least 7 days, at least 10 days, at least 14 days, at least 21 days, at least 30 days, at least 60 days, at least 90 days, at least 120 days, or at least 1 year. The pH of the chromium coating solution can vary no more than ±0.05 while in storage for at least 7 days, at least 10 days, at least 14 days, at least 21 days, at least 30 days, at least 60 days, at least 90 days, at least 120 days, or at least 1 year. The pH of the chromium coating solution can vary no more than ±0.03 while in storage for at least 7 days, at least 10 days, at least 14 days, at least 21 days, at least 30 days, at least 60 days, at least 90 days, at least 120 days, or at least 1 year.

In some embodiments, the pH of the chromium coating solution is 3.6 to 3.95. The pH of the chromium coating solution can be 3.7 to 3.9. The pH of the chromium coating solution can be 3.75 to 3.87. The chromium coating solution can be a ready-to-use chromium coating solution.

Terminology and Interpretative Conventions

The term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

Any methods described in the claims or specification should not be interpreted to require the steps to be performed in a specific order unless stated otherwise. Also, the methods should be interpreted to provide support to perform the recited steps in any order unless stated otherwise.

The compositions are described in terms of the materials that were used to form the composition with the understanding that the specific elements may not be present in the final composition in that specific form but rather may have dissociated and/or reacted with other components in the composition.

Spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The terms have, having, include, and including should be interpreted to be synonymous with the terms comprise and comprising. The use of these terms should also be understood as disclosing and providing support for narrower alternative embodiments where these terms are replaced by "consisting" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

INCORPORATION BY REFERENCE

The entire contents of each of the documents listed below are incorporated by reference into this document. If the same term is used in both this document and one or more of the incorporated documents, then it should be interpreted to have the broadest meaning imparted by any one or combination of these sources unless the term has been explicitly defined to have a different meaning in this document. If there is an inconsistency between any of the following documents and this document, then this document shall govern. The incorporated subject matter should not be used to limit or narrow the scope of the explicitly recited or depicted subject matter.

U.S. Prov. App. No. 62/505,723, titled "Stable Trivalent Chromium Coating Solution," filed on 12 May 2017.

U.S. Pat. No. 6,375,726 (application Ser. No. 09/702,225), titled "Corrosion Resistant Coatings for Aluminum and Aluminum Alloys," filed on 31 Oct. 2000, issued on 23 Apr. 2002.

U.S. Pat. No. 6,511,532 (application Ser. No. 10/012,982), titled "Post-Treatment for Anodized Aluminum," filed on 6 Nov. 2001, issued on 28 Jan. 2003.

U.S. Pat. No. 6,521,029 (application Ser. No. 10/116,844), titled "Pretreatment for Aluminum and Aluminum Alloys," filed on 5 Apr. 2002, issued on 18 Feb. 2003.

U.S. Pat. No. 6,527,841 (application Ser. No. 10/012,981), titled "Post-Treatment for Metal Coated Substrates," filed on 6 Nov. 2001, issued on 4 Mar. 2003.

U.S. Pat. No. 6,669,764 (application Ser. No. 10/351,752), titled "Pretreatment for Aluminum and Aluminum Alloys," filed on 23 Jan. 2003, issued on 30 Dec. 2003.

U.S. Pat. No. 7,018,486 (application Ser. No. 10/187,179), titled "Corrosion Resistant Trivalent Chromium Phosphated Chemical Conversion Coatings," filed on 27 Jun. 2002, issued on 28 Mar. 2006.

The portions of CN 102888138A, titled "Low-temperature anti-corrosion protective agent for surfaces of automobile parts," disclosing and describing corrosion inhibitor compounds.

The invention claimed is:

1. A method of stabilizing a trivalent chromium coating solution, the method comprising:

heating the trivalent chromium coating solution;

adjusting the pH of the trivalent chromium coating solution while heating the trivalent chromium coating solution; and cooling the trivalent chromium coating solution to ambient temperature;

wherein heating, adjusting, and cooling the trivalent chromium coating solution is performed separately from applying the trivalent chromium coating solution to a metal surface as a conversion coating, and wherein upon cooling the trivalent chromium coating solution, the pH of the trivalent chromium coating solution varies no more than ±0.15 while in storage for at least 60 days.

2. The method of claim 1 comprising heating the trivalent chromium coating solution to at least 35° C.

3. The method of claim 1 comprising heating the trivalent chromium coating solution for no more than 24 hours.

4. The method of claim 1 comprising adjusting the pH of the trivalent chromium coating solution to approximately 3.5 to approximately 4.0 while heating the trivalent chromium coating solution.

5. The method of claim 1 wherein adjusting the pH of the trivalent chromium coating solution comprises adding an alkaline material to the trivalent chromium coating solution to raise the pH of the trivalent chromium coating solution.

6. The method of claim 1 comprising mixing the trivalent chromium coating solution while adjusting the pH.

7. The method of claim 1 comprising filtering precipitates from the trivalent chromium coating solution after adjusting the pH.

8. The method of claim 1 wherein adjusting the pH of the trivalent chromium coating solution includes repeatedly raising the pH of the trivalent chromium coating solution.

9. The method of claim 1 wherein the trivalent chromium coating solution is an aqueous trivalent chromium coating solution.

10. The method of claim 1 wherein the trivalent chromium coating solution is free or substantially free of hexavalent chromium.

11. The method of claim 1 wherein the trivalent chromium coating solution comprises a fluoride compound.

12. The method of claim 1 wherein the trivalent chromium coating solution comprises a fluorozirconate compound.

13. The method of claim 1 wherein the trivalent chromium coating solution comprises a chelating agent.

14. A trivalent chromium coating solution comprising:

trivalent chromium;

water; and a corrosion inhibitor compound;

wherein the trivalent chromium coating solution has a pH of approximately 3.5 to approximately 4.0; and wherein the pH of the trivalent chromium coating solution varies no more than ±0.15 while in storage for at least 60 days.

15. The trivalent chromium coating solution of claim 14 wherein the trivalent chromium coating solution is an aqueous trivalent chromium coating solution.

16. The trivalent chromium coating solution of claim 14 comprising trivalent chromium sulfate.

17. The trivalent chromium coating solution of claim 14 comprising a fluoride compound.

18. The trivalent chromium coating solution of claim 14 comprising a fluorozirconate compound.

19. The trivalent chromium coating solution of claim 14 comprising a chelating agent.

20. The trivalent chromium coating solution of claim 19 wherein the chelating agent comprises 8-hydroxyquinoline and/or nitrilotris(methylene)triphosphonic acid.

21. The trivalent chromium coating solution of claim 14 wherein the pH of the trivalent chromium coating solution varies no more than ±0.07 while in storage for at least 60 days.

22. The trivalent chromium coating solution of claim 14 wherein the corrosion inhibitor comprises 2-mercaptobenzothiazole, 2-mercaptobenzimidazole, 2-mercaptobenzoxazole, and/or benzotriazole.

23. A trivalent chromium coating solution comprising:

trivalent chromium sulfate; and water;

wherein the trivalent chromium coating solution has a pH of approximately 3.5 to approximately 4.0;

wherein the pH of the trivalent chromium coating solution varies no more than ±0.15 while in storage for at least 60 days.

24. The trivalent chromium coating solution of claim 23 comprising a fluoride compound.

25. The trivalent chromium coating solution of claim 23 comprising a fluorozirconate compound.

26. The trivalent chromium coating solution of claim 23 comprising a chelating agent.

27. The trivalent chromium coating solution of claim 23 wherein the pH of the trivalent chromium coating solution varies no more than ±0.07 while in storage for at least 60 days.

28. The trivalent chromium coating solution of claim 23 wherein the pH of the trivalent chromium coating solution varies no more than ±0.15 while in storage for at least 120 days.

29. The trivalent chromium coating solution of claim 23 comprising a corrosion inhibitor.

30. The trivalent chromium coating solution of claim 29 wherein the corrosion inhibitor comprises 2-mercaptobenzothiazole, 2-mercaptobenzimidazole, 2- mercaptobenzoxazole, and/or benzotriazole.

31. The trivalent chromium coating solution of claim 14 wherein the pH of the trivalent chromium coating solution varies no more than ±0.15 while in storage for at least 120 days.

* * * * *